US008678618B2

(12) United States Patent
Sakai et al.

(10) Patent No.: US 8,678,618 B2
(45) Date of Patent: Mar. 25, 2014

(54) SELF-BALLASTED LAMP HAVING A LIGHT-TRANSMISSIVE MEMBER IN CONTACT WITH LIGHT EMITTING ELEMENTS AND LIGHTING EQUIPMENT INCORPORATING THE SAME

(75) Inventors: Makoto Sakai, Yokosuka (JP); Masao Segawa, Yokosuka (JP); Nobuo Shibano, Yokosuka (JP); Kiyoshi Nishimura, Yokosuka (JP); Kozo Ogawa, Yokosuka (JP); Masahiko Kamata, Yokosuka (JP); Toshiya Tanaka, Yokosuka (JP); Miho Watanabe, Yokosuka (JP); Shuhei Matsuda, Yokosuka (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 57 days.

(21) Appl. No.: 12/885,849

(22) Filed: Sep. 20, 2010

(65) Prior Publication Data

US 2011/0074290 A1 Mar. 31, 2011

(30) Foreign Application Priority Data

Sep. 25, 2009 (JP) ..... 2009-221637
Oct. 21, 2009 (JP) ..... 2009-242523

(51) Int. Cl.
*F21V 29/00* (2006.01)

(52) U.S. Cl.
USPC ..... 362/294; 362/373; 362/249.02; 362/267

(58) Field of Classification Search
USPC ..... 362/294, 373, 311.02, 267, 362/249.02–249.03, 249.04, 249.16, 363
See application file for complete search history.

(56) References Cited

U.S. PATENT DOCUMENTS

| | | | |
|---|---|---|---|
| 1,972,790 | A | 9/1934 | Olley |
| 4,355,853 | A | 10/1982 | Kourimsky |
| 4,503,360 | A | 3/1985 | Bedel |
| 4,630,182 | A | 12/1986 | Moroi |
| 4,939,420 | A | 7/1990 | Lim |

(Continued)

FOREIGN PATENT DOCUMENTS

| | | |
|---|---|---|
| CN | 1264152 | 8/2000 |
| CN | 1380704 | 11/2002 |

(Continued)

OTHER PUBLICATIONS

English Language Abstract of JP 2001-243809, published Sep. 7, 2001.

(Continued)

*Primary Examiner* — Robert May
(74) *Attorney, Agent, or Firm* — DLA Piper LLP (US)

(57) ABSTRACT

A self-ballasted lamp includes: a base body; a light-emitting module and a globe which are provided at one end side of the base body; a cap provided at the other end side of the base body; and a lighting circuit housed between the base body and the cap. The light-emitting module has light-emitting portions each using a semiconductor light-emitting element, and a support portion projected at one end side of the base body, and the light-emitting portions are disposed at least on a circumferential surface of the support portion. A light-transmissive member is interposed between the light-emitting module and an inner face of the globe.

6 Claims, 6 Drawing Sheets

(56) References Cited

U.S. PATENT DOCUMENTS 5,323,271 A 6/1994 Shimada
5,327,332 A 7/1994 Hafemeister
D356,107 S 3/1995 Watanabe et al.
5,537,301 A 7/1996 Martich
5,556,584 A 9/1996 Yamazaki
5,585,697 A 12/1996 Cote
5,607,228 A 3/1997 Ozaki et al.
5,632,551 A 5/1997 Roney
5,685,628 A 11/1997 Feger et al.
5,775,792 A 7/1998 Wiese
5,785,418 A 7/1998 Hochstein
5,857,767 A 1/1999 Hochstein
5,947,588 A 9/1999 Huang
6,095,668 A 8/2000 Rykowski et al.
6,111,359 A 8/2000 Work et al.
6,161,910 A 12/2000 Reisenauer
6,186,646 B1 2/2001 Wiedemer
6,227,679 B1 5/2001 Zhang et al.
6,234,649 B1 5/2001 Katougi
6,294,973 B1 9/2001 Kimura
6,502,968 B1 1/2003 Simon
6,517,217 B1 2/2003 Liao
6,525,668 B1 * 2/2003 Petrick ..... 340/815.45
6,598,996 B1 7/2003 Lodhie
6,641,283 B1 11/2003 Bohler
6,787,999 B2 9/2004 Stimac et al.
6,793,374 B2 9/2004 Begemann
D497,439 S 10/2004 Shaw et al.
6,814,470 B2 11/2004 Rizkin et al.
6,936,855 B1 8/2005 Harrah
6,948,829 B2 9/2005 Verdes et al.
6,982,518 B2 1/2006 Chou et al.
7,059,748 B2 6/2006 Coushaine
7,074,104 B2 7/2006 Itaya
7,111,961 B2 9/2006 Trenchard
7,125,146 B2 10/2006 Willis
7,144,140 B2 12/2006 Sun et al.
D534,665 S 1/2007 Egawa et al.
D535,038 S 1/2007 Egawa et al.
7,157,746 B2 * 1/2007 Ota et al. ..... 257/100
7,165,866 B2 * 1/2007 Li ..... 362/294
7,198,387 B1 4/2007 Gloisten et al.
7,226,189 B2 * 6/2007 Lee et al. ..... 362/294
7,281,818 B2 10/2007 You
7,300,173 B2 11/2007 Catalano
7,329,024 B2 2/2008 Lynch
7,331,689 B2 2/2008 Chen
7,347,589 B2 3/2008 Ge
7,431,477 B2 10/2008 Chou et al.
7,497,596 B2 3/2009 Ge
7,625,104 B2 12/2009 Zhang et al.
7,631,987 B2 12/2009 Wei
7,679,096 B1 3/2010 Ruffin
7,744,256 B2 6/2010 Smester
7,824,075 B2 * 11/2010 Maxik ..... 362/294
7,918,587 B2 4/2011 Hsu et al.
7,919,339 B2 4/2011 Hsu
7,947,596 B2 5/2011 Takeda
7,963,686 B2 6/2011 Hu
8,058,782 B2 11/2011 Lai
8,058,784 B2 11/2011 Treurniet
8,066,417 B2 11/2011 Balazs
8,072,130 B2 12/2011 Wang et al.
8,075,172 B2 * 12/2011 Davey et al. ..... 362/554
8,157,418 B2 4/2012 Kraus
8,226,270 B2 7/2012 Yamamoto et al.
2002/0012246 A1 * 1/2002 Rincover et al. ..... 362/186
2002/0024814 A1 2/2002 Matsuba
2002/0097586 A1 7/2002 Horowitz
2002/0118538 A1 8/2002 Calon et al.
2002/0145152 A1 10/2002 Shimomura
2002/0195918 A1 12/2002 Matsuba et al.
2003/0039122 A1 2/2003 Cao
2003/0063476 A1 4/2003 English et al.
2003/0117797 A1 6/2003 Sommers et al.
2003/0117801 A1 6/2003 Lin
2003/0137838 A1 7/2003 Rizkin et al.
2003/0151917 A1 8/2003 Daughtry
2004/0012955 A1 1/2004 Hsieh
2004/0109310 A1 6/2004 Galli
2004/0120156 A1 6/2004 Ryan
2004/0145898 A1 7/2004 Ase et al.
2004/0156191 A1 8/2004 Biasoli
2004/0218385 A1 11/2004 Tomiyoshi
2004/0232815 A1 11/2004 Tomiyoshi et al.
2005/0007772 A1 1/2005 Yen
2005/0024864 A1 2/2005 Galli
2005/0068776 A1 3/2005 Ge
2005/0073244 A1 4/2005 Chou et al.
2005/0111234 A1 5/2005 Martin et al.
2005/0162864 A1 7/2005 Verdes et al.
2005/0174769 A1 8/2005 Yong
2005/0243552 A1 11/2005 Maxik
2005/0254246 A1 11/2005 Huang
2006/0034077 A1 2/2006 Chang
2006/0043546 A1 3/2006 Kraus
2006/0092640 A1 5/2006 Li
2006/0193130 A1 8/2006 Ishibashi
2006/0193139 A1 8/2006 Sun
2006/0198147 A1 9/2006 Ge
2006/0215408 A1 9/2006 Lee
2006/0219428 A1 10/2006 Chinda et al.
2006/0227558 A1 10/2006 Osawa
2006/0239002 A1 10/2006 Chou et al.
2007/0002570 A1 1/2007 Souza
2007/0041182 A1 2/2007 Ge et al.
2007/0096114 A1 5/2007 Aoki
2007/0103904 A1 5/2007 Chen
2007/0247840 A1 10/2007 Ham
2007/0279903 A1 12/2007 Negley
2007/0285926 A1 12/2007 Maxik
2008/0002100 A1 1/2008 Kaneko
2008/0006911 A1 1/2008 Nakahara et al.
2008/0037255 A1 2/2008 Wang
2008/0080187 A1 4/2008 Purinton
2008/0084701 A1 4/2008 Van De Ven
2008/0112170 A1 5/2008 Trott
2008/0130298 A1 6/2008 Negley
2008/0173883 A1 7/2008 Hussell
2008/0224608 A1 9/2008 Konishi
2008/0289867 A1 11/2008 Owens
2009/0059595 A1 3/2009 Ge
2009/0116229 A1 5/2009 Dalton
2009/0116231 A1 5/2009 Miller
2009/0161356 A1 6/2009 Negley
2009/0175041 A1 * 7/2009 Yuen et al. ..... 362/294
2009/0184616 A1 7/2009 Van De Ven
2009/0184646 A1 7/2009 Devaney
2009/0207602 A1 8/2009 Reed
2009/0257220 A1 10/2009 Lenk
2009/0294780 A1 12/2009 Chou
2009/0315442 A1 12/2009 Rooymans
2010/0026157 A1 2/2010 Tanaka
2010/0060130 A1 3/2010 Li
2010/0067241 A1 3/2010 Lapatovich
2010/0096992 A1 4/2010 Yamamoto
2010/0207534 A1 8/2010 Dowling
2010/0219735 A1 9/2010 Sakai et al.
2010/0225220 A1 9/2010 Tanaka et al.
2010/0237761 A1 9/2010 Osawa et al.
2010/0237779 A1 9/2010 Osawa et al.
2010/0244650 A1 9/2010 Osawa et al.
2010/0244694 A1 9/2010 Osawa et al.
2010/0253200 A1 10/2010 Osawa et al.
2010/0277082 A1 11/2010 Reed
2010/0287652 A1 11/2010 Popi
2010/0289396 A1 11/2010 Osawa
2010/0313983 A1 12/2010 Aoki
2010/0315442 A1 12/2010 Pauritsch
2010/0327746 A1 12/2010 Hisayasu
2010/0327751 A1 12/2010 Takenaka et al.
2011/0025206 A1 2/2011 Hiramatsu et al.
2011/0043120 A1 2/2011 Panagotacos
2011/0050133 A1 3/2011 Grajcar

(56) References Cited

U.S. PATENT DOCUMENTS

| | | | |
|---|---|---|---|
| 2011/0063842 | A1 | 3/2011 | Takei et al. |
| 2011/0068674 | A1 | 3/2011 | Takenaka et al. |
| 2011/0074269 | A1 | 3/2011 | Hisayasu et al. |
| 2011/0074271 | A1 | 3/2011 | Takeshi et al. |
| 2011/0074290 | A1 | 3/2011 | Sakai et al. |
| 2011/0074291 | A1 | 3/2011 | Osawa et al. |
| 2011/0079814 | A1 | 4/2011 | Chen |
| 2011/0084956 | A1 | 4/2011 | Choi |
| 2011/0089806 | A1 | 4/2011 | Suwa et al. |
| 2011/0090691 | A1 | 4/2011 | Markle et al. |
| 2011/0139491 | A1 | 6/2011 | Chang |
| 2011/0156569 | A1 | 6/2011 | Osawa |
| 2011/0210664 | A1 | 9/2011 | Hisayasu et al. |
| 2011/0299695 | A1 | 12/2011 | Nicholson |

FOREIGN PATENT DOCUMENTS

| | | |
|---|---|---|
| CN | 1433070 | 7/2003 |
| CN | 1644978 | 7/2005 |
| CN | 1880844 | 12/2006 |
| CN | 201014266 | 1/2008 |
| CN | 201081193 | 7/2008 |
| CN | 101307887 | 11/2008 |
| CN | 201180976 | 1/2009 |
| CN | 101506934 | 8/2009 |
| CN | 101521140 | 9/2009 |
| DE | 10 2004 042186 | 3/2006 |
| DE | 20 2008 016 231 | 4/2009 |
| DE | 20 2008 016 868 | 4/2009 |
| EP | 1 215 735 | 6/2002 |
| EP | 1705421 | 9/2006 |
| EP | 2037633 | 3/2009 |
| EP | 2149742 | 2/2010 |
| EP | 2 163 808 | 3/2010 |
| JP | 57-152706 | 9/1982 |
| JP | 59-035303 | 2/1984 |
| JP | 61-35216 | 2/1986 |
| JP | 62-190366 | 12/1987 |
| JP | 63-5581 | 1/1988 |
| JP | 63-102265 | 5/1988 |
| JP | 64-7204 | 1/1989 |
| JP | 1-206505 | 8/1989 |
| JP | 2-91105 | 3/1990 |
| JP | 2000-083343 | 3/2000 |
| JP | 2000-173303 | 6/2000 |
| JP | 2001-243809 | 9/2001 |
| JP | 2002-093206 | 3/2002 |
| JP | 2002-525814 | 8/2002 |
| JP | 2002-280617 | 9/2002 |
| JP | 2003-016808 | 1/2003 |
| JP | 2003-051209 | 2/2003 |
| JP | 2003-059305 | 2/2003 |
| JP | 2003-59330 | 2/2003 |
| JP | 2003-92022 | 3/2003 |
| JP | 2004-6096 | 1/2004 |
| JP | 2004-119078 | 4/2004 |
| JP | 2004-193053 | 7/2004 |
| JP | 2004-6096 | 8/2004 |
| JP | 2004-221042 | 8/2004 |
| JP | 2004-265730 | 9/2004 |
| JP | 2005-93097 | 4/2005 |
| JP | 2005-123200 | 5/2005 |
| JP | 2005-513815 | 5/2005 |
| JP | 2005-166578 | 6/2005 |
| JP | 3112794 | 7/2005 |
| JP | 2005-217354 | 8/2005 |
| JP | 2005-286267 | 10/2005 |
| JP | 2006-040727 | 2/2006 |
| JP | 3121916 | 5/2006 |
| JP | 2006-156187 | 6/2006 |
| JP | 2006-244725 | 9/2006 |
| JP | 2006-28646 | 10/2006 |
| JP | 2006-310057 | 11/2006 |
| JP | 2006-313717 | 11/2006 |
| JP | 2006-313718 | 11/2006 |
| JP | 2007-059260 | 3/2007 |
| JP | 2007-073306 | 3/2007 |
| JP | 2007-073478 | 3/2007 |
| JP | 2007-188832 | 7/2007 |
| JP | 2007-207576 | 8/2007 |
| JP | 2007-317573 | 12/2007 |
| JP | 2008-027910 | 2/2008 |
| JP | 2008-91140 | 4/2008 |
| JP | 2008-227412 | 9/2008 |
| JP | 2008-277561 | 11/2008 |
| JP | 2009-37995 | 2/2009 |
| JP | 2009-037995 | 2/2009 |
| JP | 2009-117342 | 5/2009 |
| JP | 2009-135026 | 6/2009 |
| JP | 2009-164157 | 7/2009 |
| JP | 2009-206104 | 8/2009 |
| JP | 2010-040223 | 2/2010 |
| WO | WO 03/056636 | 7/2003 |
| WO | WO 2005/024898 | 3/2005 |
| WO | WO 2006/118457 | 11/2006 |
| WO | WO 2007/130358 | 11/2007 |
| WO | WO 2007/130359 | 11/2007 |
| WO | WO 2008/146694 | 12/2008 |
| WO | WO2009/085231 | 7/2009 |
| WO | WO 2009/085231 | 7/2009 |
| WO | WO 2009/087897 | 7/2009 |

OTHER PUBLICATIONS

English Language Abstract of JP Publication 01-206505 published Aug. 18, 1989.

English Language Abstract of JP Publication 2005-093097 published Apr. 7, 2005.

English Language Abstract of JP Publication 2005-123200 published May 12, 2005.

English Language Abstract of JP 2006-313718, published Nov. 16, 2006.

English Language Abstract of JP Publication 63-005581 published Jan. 11, 1988.

English Language Abstract of JP Publication 64-007402 published Jan. 11, 1989.

English Language Machine Translation of JP 2000-083343, published Mar. 21, 2000.

English Language Machine Translation of JP 2000-173303 published Jun. 23, 2000.

English Language Machine Translation of JP 2001-243809, published Sep. 7, 2001.

English Language Machine translation of JP 2003-59330 published Feb. 28, 2003.

English Language Machine Translation of JP 2004-006096 published Jan. 8, 2004.

English Language Machine Translation of JP 2004-193053 published Jul. 8, 2004.

English Language Machine Translation of JP 2005-166578 published Jun. 23, 2005.

English Language Machine translation of JP 2005-513815 published May 12, 2005.

English Language Machine translation of JP 2006-040727 published Feb. 9, 2006.

English Language Machine Translation of JP 2006-310057, published Nov. 9, 2006.

English Language Machine Translation of JP 2006-313718, published Nov. 16, 2006.

English Language Machine translation of JP 2008-91140 published Apr. 17, 2008.

English Language Machine Translation of JP 2009-37995, published Feb. 19, 2009.

English Language Machine Translation of JP 3121916, published May 10, 2006.

English Language Machine Translation of JP Publication 2005-093097 published Apr. 7, 2005.

English Language Machine Translation of JP Publication 2005-123200.

(56) References Cited

OTHER PUBLICATIONS

English Language Machine translation of JP-2002-280617published Sep. 27, 2002.
English Language Machine translation of JP-2005-286267 published Oct. 13, 2005.
English Language Machine translation of JP-2006-244725 published Sep. 14, 2006.
English Language Machine Translation ofJP 2003-092022 published Mar. 28, 2003.
English Language Translation of Office Action issued in corresponding Japanese Appl 2005-221571 on Oct. 20, 2009.
English Language Translation of International Search Report for PCT/JP2008/073436 mailed Mar. 24, 2009.
English translation of Office Action issued in corresponding Japanese Appl 2005-221571 on Jul. 7, 2009.
English translation of Office Action issued in corresponding Japanese Appl 2005-221571 on Aug. 25, 2009.
English Language Translation of Office Action issued in Japanese Appl 2005-221688 on Jan. 26, 2010.
Machine English language translation of JP-2003-016808 published Jan. 17, 2003.
Office Action issued in corresponding Japanese Appl 2005-221571 on Jul. 7, 2009.
Office Action issued in corresponding Japanese Appl 2005-221571 on Aug. 25, 2009.
Office Action issued in corresponding Japanese Appl 2005-221571 on Oct. 20, 2009.
Search Report of International Application No. PCT/JP2008/068625 mailed Dec. 9, 2008.
English Language Abstract of JP 2004-193053 published Jul. 8, 2004.
English Language Abstract of JP 2-91105 published Mar. 30, 1990.
English Language Abstract of JP 2000-173303 published Jun. 23, 2000.
English Language Abstract of JP 2003-092022 published Mar. 28, 2003.
English language abstract of JP-2002-280617 published Sep. 27, 2002.
English language abstract of JP-2003-016808 published Jan. 17, 2003.
English Language Abstract of 2003-59330 published Feb. 28, 2003.
English Language Abstract of JP 2005-166578 published Jun. 23, 2005.
English language abstract of JP-2005-286267 published Oct. 13, 2005.
English Language Abstract of JP 2006-040727 published Feb. 9, 2006.
English language abstract of JP-2006-244725 published Sep. 14, 2006.
English Language Abstract of JP 2008-91140 published Apr. 17, 2008.
English Language Abstract of JP 2004-006096 published Jan. 8, 2004.
Office Action issued in Japanese Appl 2005-221688 on Jan. 26, 2010.
English Language Abstract of JP 2009-37995, published Feb. 19, 2009.
English Language Abstract of JP 2000-083343, published Mar. 21, 2000.
English Language Abstract of JP 57-152706 published Sep. 21, 1982.
English Language Abstract of JP 2006-310057, published Nov. 9, 2006.
International Preliminary Report on Patentability and Written Opinion issued in PCT/JP2008/068625 mailed May 11, 2010.
Office Action issued in Japanese Appl 2005-371406 on Apr. 20, 2010.
English Translation of Office Action issued in Japanese Appl 2005-371406 on Apr. 20, 2010.
U.S. Appl. No. 12/825,650.
U.S. Appl. No. 12/794,476.
U.S. Appl. No. 12/794,509.
U.S. Appl. No. 12/794,558.
U.S. Appl. No. 12/738,081.
Japanese Office Action issued in JP 2008-198625 on May 26, 2010.
English Translation of Japanese Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.
English Language Abstract of JP 2009-135026 published Jun. 18, 2009.
English Language Translation of JP 2009-135026 published Jun. 18, 2009.
English Language Abstract of JP 2002-525814 published Aug. 13, 2002.
English Language Abstract of JP 2003-059305 published Feb. 28, 2003.
English Language Translation of JP 2003-059305 published Feb. 28, 2003.
English Language Abstract of JP 2009-037995 published Feb. 19, 2009.
English Language Translation of JP 2009-037995 published Feb. 19, 2009.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.
English Language Translation of JP 2007-073306 published Mar. 22, 2007.
U.S. Appl. No. 12/880,490.
U.S. Appl. No. 12/933,969.
U.S. Appl. No. 12/885,849.
U.S. Appl. No. 12/886,123.
U.S. Appl. No. 11/399,492 (now U.S. Patent 7,758,223).
Extended European Search Report issued in EP Appl 10006720.6 on Oct. 13, 2010.
English Language Abstract of JP 61-35216 published Feb. 2, 1086.
IPRP & WO issued in PCT/JP2008/073436 on Aug. 10, 2010.
English Language Translation of JP 2002-525814 published Aug. 13, 2002.
English Language Abstract of JP 2006-156187 published Jun. 15, 2006.
English Language Translation of JP 2006-156187 published Jun. 15, 2006.
U.S. Appl. No. 13/044,369.
U.S. Appl. No. 12/888,921.
U.S. Appl. No. 13/034,959.
U.S. Appl. No. 13/172,557.
Extended European Search Report issued in EP 111560003.9 on May 18, 2011.
Extended European Search Report issued in EP 08838942.4 on Jun. 1, 2011.
English Language Abstract of JP 2008-277561 published on Nov. 13, 2008.
English Language Translation of JP 2008-277561 published on Nov. 13, 2008.
English Language Abstract of JP 2008-227412 published Sep. 25, 2008.
English Language Translation of JP 2008-227412 published Sep. 25, 2008.
Japanese Office Action issued in 2005-269017 on Jan. 13, 2011.

(56) References Cited

OTHER PUBLICATIONS

English Language Translation of Japanese Office Action issued in 2005-269017 on Jan. 13, 2011.
English Language Abstract of JP 2004-221042 published Aug. 5, 2004.
English Language Translation of JP 2004-221042 published Aug. 5, 2004.
English Language Abstract of JP 63-102265 published May 7, 1988.
English Language Abstract of JP 2009-206104 published Sep. 10, 2009.
English Language Translation of JP 2009-206104 published Sep. 10, 2009.
European Search Report issued in EP 10178361.1 on Jul. 4, 2011.
U.S. Appl. No. 13/221,551.
U.S. Appl. No. 13/172,557, filed Jun. 29, 2011, Pending.
U.S. Appl. No. 13/221,519, filed Aug. 30, 2011, Pending.
U.S. Appl. No. 13/221,551, filed Aug. 30, 2011, Pending.
Chinese Office Action issued in CN 201010216943 on Jul. 11, 2012.
English Language Translation of Chinese Office Action issued in CN 201010216943 on Jul. 11, 2012.
Chinese Office Action issued in CN 200910176110.2 dates Jul. 4, 2012.
English Language Translation of Chinese Office Action issued in CN 200910176110.2 dates Jul. 4, 2012.
Japanese Office Action issued in JP 2010-042528 on Nov. 14, 2012.
English Language Translation of Japanese Office Action issued in JP 2010-042528 on Nov. 14, 2012.
English Language Abstract of JP 2010-040223 published Feb. 18, 2010.
English Language Translation of JP 2010-040223 published Feb. 18, 2010.
English Language Abstract of JP 2007-073478 published Mar. 22, 2007.
English Language Translation of JP 2007-073478 published Mar. 22, 2007.
English Language Abstract of JP 2002-093206 published Mar. 29, 2002.
English Language Translation of JP 2002-093206 published Mar. 29, 2002.
U.S. Appl. No. 12/794,379.
U.S. Appl. No. 12/794,429.
U.S. Appl. No. 12/811,795.
U.S. Appl. No. 12/713,230.
U.S. Appl. No. 12/825,956.
U.S. Appl. No. 12/845,330.
U.S. Appl. No. 12/885,005.
U.S. Appl. No. 12/886,025.
U.S. Appl. No. 13/221,519.
Chinese Office Action issued in CN 201010216943 on Oct. 26, 2011.
English Language Translation of Chinese Office Action issued in CN 201010216943 on Oct. 26, 2011.
English Language Abstract of CN 101307887 published Nov. 19, 2008.
English Language Translation of JP 2009/117342 published May 28, 2009.
English Language Abstract of JP 2009/117342 published May 28, 2009.
English Language Abstract of JP 2004-119078 published Apr. 15, 2004.
English Language Translation of JP 2004-119078 published Apr. 15, 2004.
Chinese Office Action issued in CN 201010121809.11 on Mar. 31, 2012.
English Translation of Chinese Office Action issued in CN 201010121809.11 on Mar. 31, 2012.
English Language Abstract and Claims of CN201149860 published Nov. 12, 2008.
English Language Abstract and Claims of CN201072113 published Jun. 11, 2008.
English Language Abstract of CN2602514 published Feb. 4, 2004.
Extended European Search Report for EP 10179580.5, dated May 24, 2012.
Chinese Office Action issued in CN 201010243165.3 on Jul. 17, 2012.
English Language Translation of Chinese Office Action issued in CN 201010243165.3 on Jul. 17, 2012.
English Language Abstract of CN 1264152 published Aug. 23, 2000.
Chinese Office Action issued in CN2010102793033 on Jul. 10, 2012.
English Language Translation of Chinese Office Action issued in CN2010102793033 on Jul. 10, 2012.
English Language Abstract of JP 2005-217354 published Aug. 11, 2005.
English Language Translation of JP 2005-217354 published Aug. 11, 2005.
English Language Abstract of JP 2006-286461 published Oct. 19, 2006.
English Language Translation of JP 2006-286461 published Oct. 19, 2006.
English Language Abstract of WO 2009/085231 published Jul. 9, 2009.
English Language Abstract of CN 1644978 published Jul. 27, 2005.
Related U.S. Appl. No. 12/933,969.
Related U.S. Appl. No. 12/885,849.
Related U.S. Appl. No. 12/886,025.
Related U.S. Appl. No. 13/172,557.
Chinese Office Action issued in CN 201010292756 dated Jun. 29, 2012.
U.S. Appl. No. 60/797,146, filed May 2, 2006, Lenk.
English Language Translation of Chinese Office Action issued in CN 201010292756 dated Jun. 29, 2012.
English Language Abstract of CN 201014266 published Jan. 30, 2008.
Chinese Office Action issued in CN 201010292760.6 dated Sep. 10, 2012.
English Language Translation of Chinese Office Action issued in CN 201010292760.6 dated Sep. 10, 2012.
English Language Abstract of CN 201081193 published Jul. 2, 2008.
English Language Abstract of CN 1380704 published Nov. 20, 2002.
English Language Abstract of CN 101521140 published Sep. 2, 2009.
English Language Abstract of CN 101506934 published Aug. 12, 2009.
English Language Abstract of CN 201180976 published Jan. 14, 2009.
English Language Abstract of CN 1880844 published Dec. 20, 2006.
Chinese Office Action issued in CN 201010292771.4 dated Jun. 19, 20123.
English Language Translation of Chinese Office Action issued in CN 201010292771.4 dated Jun. 19, 20123.
Japanese Office Action issued in JP2009-219771 on Aug. 9, 2012.
English Language Translation of Japanese Office Action issued in JP2009-219771 on Aug. 9, 2012.
English Language Abstract of JP 2009-164157 published Jul. 23, 2009.
English Language Tranlsation of JP 2009-164157 published Jul. 23, 2009.
Chinese Office Action issued in CN201010287917.6 dated Jun. 27, 2012.
English Language Translation of Chinese Office Action issued in CN201010287917.6 dated Jun. 27, 2012.
English Language Abstract of CN 1433070 published Jul. 30, 2003.
Japanese Office Action issued in JP 2009-221637 on Mar. 13, 2013.
English Language Translation of Japanese Office Action issued in JP 2009-221637 on Mar. 13, 2013.
English Language Abstract of JP 2007-059260 published Mar. 8, 2007.
English Language Translation of JP 2007-059260 published Mar. 8, 2007.
English Language Translation of JP 3112794 published Jul. 13, 2005.
Extended European Search Report issued in EP10178363.7 on Mar. 14, 2013.
Related U.S. Appl. No. 12/825,650.
Related U.S. Appl. No. 12/738,081.

(56) References Cited

OTHER PUBLICATIONS

Related U.S. Appl. No. 12/880,490.
Related U.S. Appl. No. 12/845,330.
Related U.S. Appl. No. 12/885,005.
Related U.S. Appl. No. 12/886,123.
Related U.S. Appl. No. 13/044,369.
Related U.S. Appl. No. 12/888,921.
Japanese Office Action issued in JP 2009-221637 published May 22, 2013.
English Language Translation of Japanese Office Action issued in JP 2009-221637 published May 22, 2013.
English Language Abstract of JP 2004-265730 published Sep. 24, 2004.
English Language Translation of JP 2004-265730 published Sep. 24, 2004.
English Language Abstract of JP 2007-317573 published Dec. 6, 2007.
English Language Translation of JP 2007-317573 published Dec. 6, 2007.
Related U.S. Appl. No. 12/811,795.
Related U.S. Appl. No. 13/034,959.
Related U.S. Appl. No. 12/794,379.
Related U.S. Appl. No. 12/794,509.
Related U.S. Appl. No. 12/825,956.
Related U.S. Appl. No. 12/794,429.
Related U.S. Appl. No. 12/794,476.
Related U.S. Appl. No. 12/713,230.
Related U.S. Appl. No. 13/221,519.
Related U.S. Appl. No. 13/221,551.

* cited by examiner

SELF-BALLASTED LAMP HAVING A LIGHT-TRANSMISSIVE MEMBER IN CONTACT WITH LIGHT EMITTING ELEMENTS AND LIGHTING EQUIPMENT INCORPORATING THE SAME

INCORPORATION BY REFERENCE

The present invention claims priority under 35 U.S.C. §119 to Japanese Patent Application Nos. 2005-221637 and 2009-242523 filed on Sep. 25, 2009 and Oct. 21, 2009, respectively. The contents of these applications are incorporated herein by reference in their entirety.

FIELD

Embodiments described herein relate generally to a self-ballasted lamp having light-emitting portions each using a semiconductor light-emitting element and lighting equipment using the self-ballasted lamp.

BACKGROUND

In a conventional self-ballasted lamp having light-emitting portions each using an LED chip as a semiconductor light-emitting element, a light-emitting module, on which the light-emitting portions are mounted, and a globe for covering the light-emitting module are attached to one end side of a metallic base body, a cap is attached to the other end side of the base body via an insulating member, and a lighting circuit for supplying power to the LED chips of the light-emitting portions to light the self-ballasted lamp is housed inside the insulating member.

A light-emitting module is generally structured so that light-emitting portions are mounted on one face of a flat substrate, and the other face of the substrate is brought into face-contact with the base body and thermally-conductively attached to the base body.

While the self-ballasted lamp is lit, heat mainly generated by the LED chips of the light-emitting portions is conducted from the flat substrate to the base body and radiated into the air from a surface, which is exposed to the outside the base body.

Additionally, as a light-emitting module, a self-ballasted lamp exists in which, a plurality of light-emitting portions are arranged on a surface of a three-dimensional substrate formed in a globe, the three-dimensional substrate being formed of a regular-pyramid-shaped or cubic substrate or formed by bending a substrate in a sphere shape.

However, when the three-dimensional substrate is used for the light-emitting module, almost the entire light-emitting module is arranged in an air layer having a low thermal conductivity and only a part, which is supported, of the light-emitting module is connected to the base body. Accordingly, compared with the light-emitting module in which the flat substrate is thermally-conductively brought into face-contact with the base body, it becomes more difficult to efficiently conduct, heat, which is generated by the LED chips of the light-emitting portions when the self-ballasted lamp is lit, to the base body. Therefore, the temperature of each light-emitting portion arranged in the air layer easily rises, and the life of each LED chip is shortened. Additionally, in order to suppress the temperature rise of the LED chips, power to be input to the LED chips is required to be reduced and light output is required to be suppressed.

Particularly, when a small mini-krypton type self-ballasted lamp is used, a base body is small in dimensions and sufficient radiation performance is hardly obtained from the base body. Therefore, not only in the case of using the three-dimensional substrate of the light-emitting module but also in the case of using the flat substrate of the module, a problem arises that sufficient radiation performance cannot be obtained only by thermal conduction to the base body.

The present invention has been made in view of the above problems and aims to provide a self-ballasted lamp capable of improving radiation performance, and lighting equipment.

DETAILED DESCRIPTION

A self-ballasted lamp of each embodiment includes: a base body; a light-emitting module and a globe which are provided at one end side of the base body; a cap provided at the other end side of the base body; and a lighting circuit housed between the base body and the cap. The light-emitting module has light-emitting portions each using a semiconductor light-emitting element; and a support portion projected at one end side of the base body, and the light-emitting portions are respectively disposed at least on a circumferential surface. A light-transmissive member is interposed between the light-emitting module and an inner face of a globe.

Next, Embodiment 1 will be described with reference to FIGS. 1 to 4.

Figure 1:
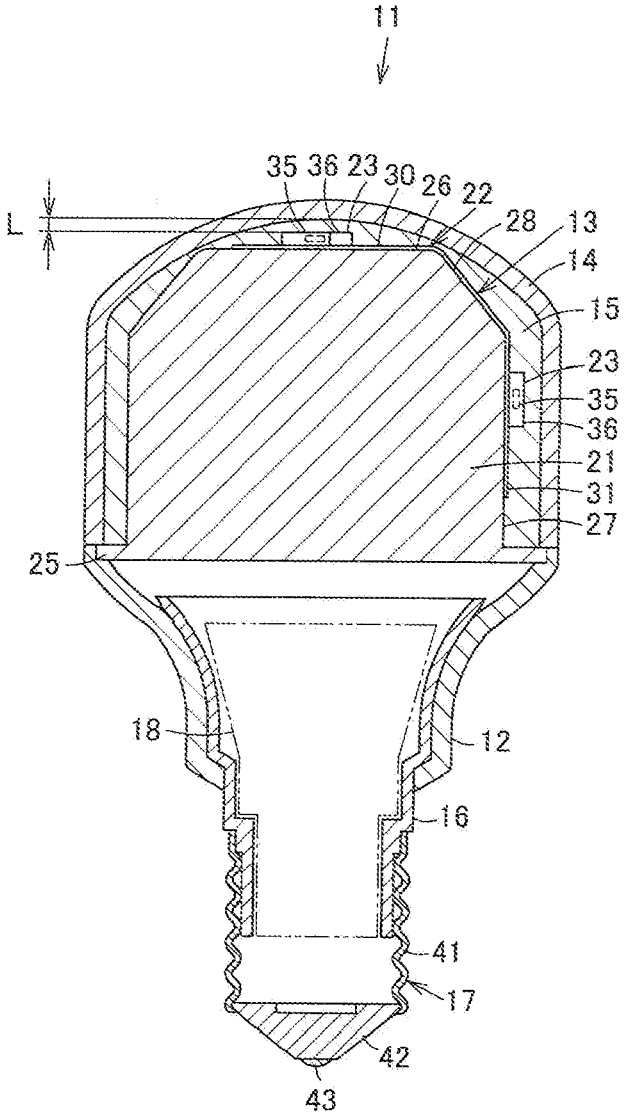
FIG. 1 is a cross sectional view of a self-ballasted lamp of Embodiment 1.
Figure 2:
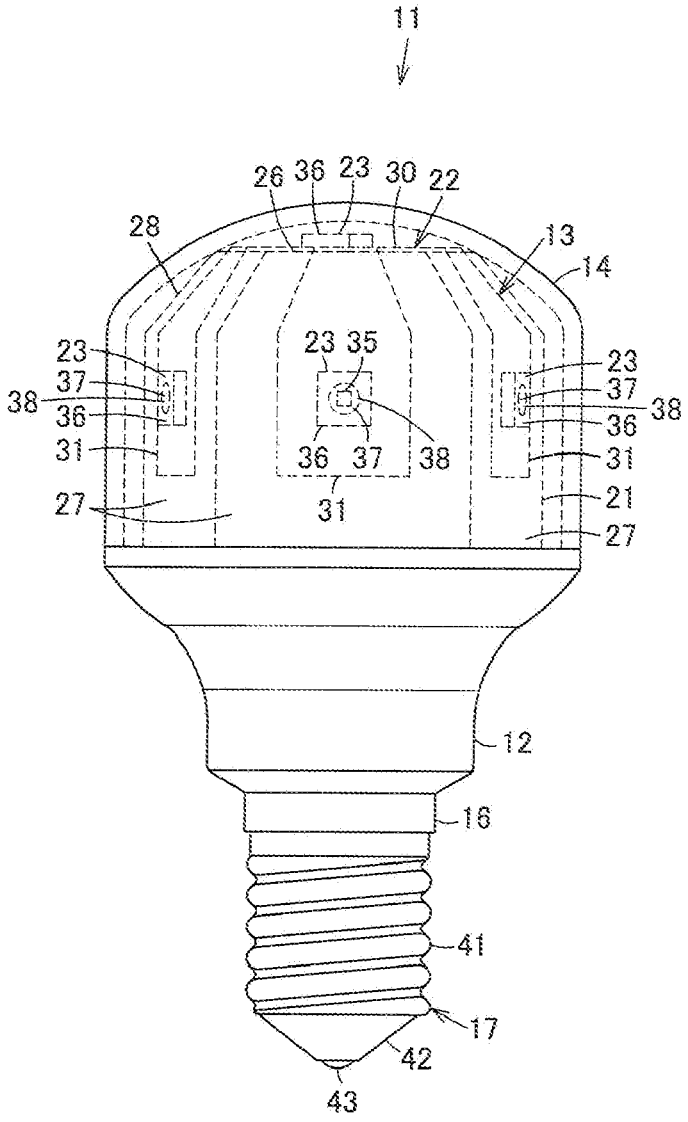
FIG. 2 is a side view of the self-ballasted lamp.

In FIGS. 1 and 2, the reference numeral 11 denotes, for example, a mini-krypton size self-ballasted lamp. The self-ballasted lamp 11 includes: a base body 12, a three-dimensional light-emitting module 13 which is attached to one end side (one end side in a lamp axial direction connecting a globe and cap of the self-ballasted lamp 11 to each other) of the base body 12; a globe 14 which contains the light-emitting module 13 and is attached to one end side of the base body 12; a light-transmissive member 15 with which a gap between the light-emitting module 13 and the globe 14 is filled and which has light-transmissivity; an insulating cover 16 attached to the other end side of the base body 12; a cap 17 attached to the other end side of the cover 16; and a lighting circuit 18 which is located between the base body 12 and the cap 17 and housed inside the cover 16.

The base body 12 is made of metal such as aluminum excellent in thermal conductivity, and is formed in a cylindrical shape the diameter of which increases toward one end side of the base body.

The light-emitting module 13 includes: a three-dimensional support portion 21; a substrate 22 which is arranged along a surface of the support portion 21; and light-emitting portions 23 which are mounted on the substrate 22.

The support portion 21 is made of metal such as aluminum excellent in thermal conductivity, and an attachment portion 25 is formed at the other end of the support portion 21, the attachment portion 25 having a circumferential portion to be engaged with an inner edge portion of one end opening of the base body 12 and being thermally-conductively attached to the base body 12. On one end face of the support portion 21, a flat attachment face 26 is formed, a plurality of, for example, five-flat attachment faces 27 are formed on the outer circumferential faces around a lamp axis of the support portion 21, and therefore the support portion 21 is formed in a three-dimensional shape in accordance with the shape of the globe 14. An inclined face 28 for preventing interference with an inner face of the globe 14 is formed between the attachment face 26 of one end side and one end side of the circumferential attachment face 27 of the support portion 21.

Figure 3:
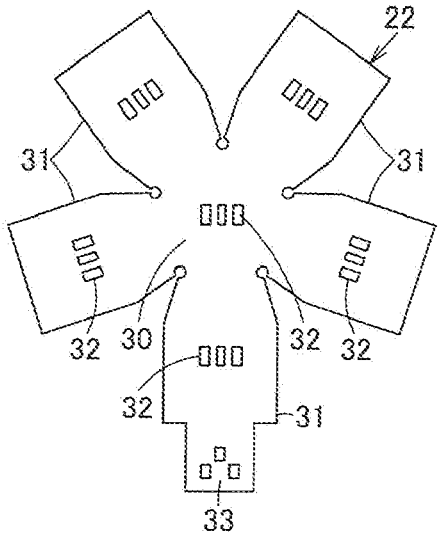
FIG. 3 is a development view of a flexible substrate which a light-emitting module of the self-ballasted lamp includes.

The substrate 22 is integrally formed of, for example, a lead frame and flexible substrate, as shown in the development view of FIG. 3, integrally formed in one sheet, and provided with a center substrate portion 30 and a plurality of outside substrate portions 31 formed in a radiating manner from the center substrate portion 30. Pad portions 32, on which the light-emitting portions 23 are mounted respectively, are formed on the center substrate portion 30 and each outside substrate portion 31. A connection portion 33, which is connected to the lighting circuit 18 through a space between the base body 12 and the support portion 21, is extended on a top end of one of the outside substrate portions 31.

For the light-emitting portion 23, an SMD (Surface Mount Device) package with connection terminals 36 on which an LED chip 35 as a semiconductor light-emitting element is loaded is used. In the SMD package 36, the LED chip 35 emitting, for example, blue light is arranged in a package and sealed with a phosphor layer 37 made of, for example, silicone resin in which a yellow phosphor is mixed which is excited by a part of the blue light emitted from the LED chip 35 and radiates yellow light. Accordingly, a surface of the phosphor layer 37 serves as a light-emitting face 38, and white-based light is radiated from the light-emitting face 38. Terminals (not shown) to be connected by soldering to the substrate 22 are arranged on a back face of the SMD package 36.

The center substrate portion 30 of the substrate 22, on which the plurality of light-emitting portions 23 are mounted, is fixed, by, for example, adhesive, to the attachment face 26 constituting one end face: of the support portion 21, so that each outside substrate portion 31 is fixed along each attachment face 27 on the circumferential face of the support portion 21. Thus, the three-dimensional light-emitting module 13 is formed.

The globe 14 is made of, for example, synthetic resin or glass having light-transmissivity and light-diffuseness in a dome shape so as to contain and cover the three-dimensional light-emitting module 13. An edge portion of the other end opening of the globe 14 is engaged with and fixed to the base body 12 by adhesive or the like.

The light-emitting module 13 and the globe 14 are formed so that a distance L between the light-emitting face 38 of each light-emitting portion 23 of the light-emitting module 13 and the inner face of the globe 14 is 2 mm or less.

The light-transmissive member 15 is made of, for example, transparent resin such as transparent silicone resin, and a gap between a surface of the light-emitting module 13 and the inner face of the globe 14 is filled with the light-transmissive member 15 so that almost no air layer exists therebetween.

The cover 16 is made of, for example, an insulating material such as PBT resin, formed in a cylindrical shape the diameter of which increases toward one end side of the base body, and one end side of the cover 16 is fitted in the base body 12, and the other end side thereof is projected from the base body 12.

The cap 17 is, for example, an E17 type cap connectable to a socket for general illuminating bulbs, and has a shell 41 which is engaged with, caulked by and fixed to the other end of the cover 16 projecting from the base body 12; insulating portion 42 provided at the other end side of the shell 41; and an eyelet 43 provided at a top portion of the insulating portion 42.

The lighting circuit 18 is, for example, a circuit for supplying constant current to the LED chips 35 of the light-emitting module 13 and has a circuit substrate on which a plurality of circuit elements constituting the circuit are mounted, and the circuit substrate is housed and fixed in the cover 16. The shell 41 and eyelet 43 of the cap 17 are electrically connected to an input side of the lighting circuit 18 by electric wires. The connection portion 33 of the substrate 22 of the light-emitting module 13 is connected to an output side of the lighting circuit 18.

Figure 4:
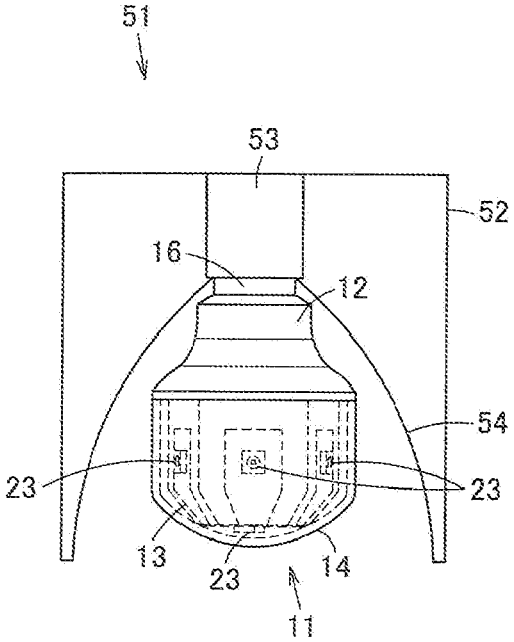
FIG. 4 is a cross sectional view of lighting equipment using the self-ballasted lamp.

FIG. 4 shows lighting equipment 51 which uses the self-ballasted lamp 11 and is a downlight, the lighting equipment 51 has an equipment body 52, and a socket 53 and a reflecting body 54 are disposed in the equipment body 52.

When the self-ballasted lamp 11 is energized by attaching the cap 17 to the socket 53 of the lighting equipment 51, the lighting circuit 18 operates, power is supplied to the LED chip 35 of each light-emitting portion 23 of the light-emitting module 13, the LED chip 35 emits light, and light radiated from the light-emitting face 38 of each light-emitting portion 23 is diffused and radiated through the light-transmissive member 15 and the globe 14.

A part of heat, which is generated from the LED chip 35 of each light-emitting portion 23 of the light-emitting module 13 when the self-ballasted lamp 11 is lit, is conducted to the substrate 22, the support portion 21 and the base body 12 in this order and radiated into the air from an outer surface of the base body 12.

Another part of the heat generated from the LED chip 35 of each light-emitting portion 23 of the light-emitting module 13 is directly conducted from the light-emitting portion 23 to the light-transmissive member 15, and is conducted from the light-emitting portion 23 to the substrate 22 and the support portion 21. The heat is then conducted from surfaces of the substrate 22 and support portion 21 to the light-transmissive member 15 and further conducted from the light-transmissive member 15 to the globe 14, and radiated from an outer face of the globe 19 into the air. Here, since no air layer having a low thermal conductivity exists between each light-emitting portion 23 and the globe 14, the heat is efficiently conducted from each light-emitting portion 23 to the globe 14.

According to the self-ballasted lamp 11 of the embodiment, since the light-transmissive member 15 having light-transmissivity is filled between the three-dimensional light-emitting module 13 and the inner face of the globe 14, when the self-ballasted lamp 11 is lit, the heat generated from the LED chips 35 is efficiently conducted to the globe 14 and can be efficiently radiated from the outer face of the globe 14, and radiation performance can be improved with use of the three-dimensional light-emitting module 13.

Thus, even in the case where a mini-krypton type small-sized self-ballasted lamp 11 is used, and the base body 12 is small in dimensions and sufficient radiation performance is hard to obtain from the base body 12, radiation performance can sufficiently be secured from the globe 14 and light output can be improved by increasing power to be input to the LED chips 35.

Since the three-dimensional light-emitting module 13 is used in which the light-emitting portions 23 are respectively arranged on the surfaces of the three-dimensional support portion 21, a surface area of the light-emitting module 13 can be made large, heat can be efficiently conducted from the light-emitting module 13 to the light-transmissive member 15 and the radiation performance can be further improved.

Since the distance L between the light-emitting portion 23 of the light-emitting module 13 and the inner face of the globe 14 is 2 mm or less, the heat generated from the LED chips 35 when the self-ballasted lamp 11 is lit can be further efficiently conducted to the globe 14 and the radiation performance can be further improved. Moreover, if the distance L between the light-emitting portion 23 of the light-emitting module 13 and the inner face of the globe 14 is thus 2 mm or less, compared with a distance L larger than 2 mm, the thermal conductivity from the light-emitting portions 23 to the globe 14 can be further improved. Additionally, as long as the light-emitting module 13 can be arranged in the globe 14 by, for example, elastically deforming the globe 14 in assembling the self-ballasted lamp 11, part of the light-emitting portions 23 of the light-emitting module 13 may come into contact with the inner face of the globe 14, that is, the distance L may be 0 mm.

Moreover, the light-emitting portions 23 may be respectively fixed to the surfaces of the support portion 21 via individual wiring substrates without use of the substrate 22. Additionally, the light-emitting portions 23 may be directly attached to the outer circumferential faces of the support portion 21, respectively. Additionally, it is permitted that, a housing space is formed inside the support portion 21 and the lighting circuit 18 is housed in the housing space for downsizing the lamp.

Next, Embodiment 2 will be described with reference to FIGS. 5 to 7.

Figure 5:
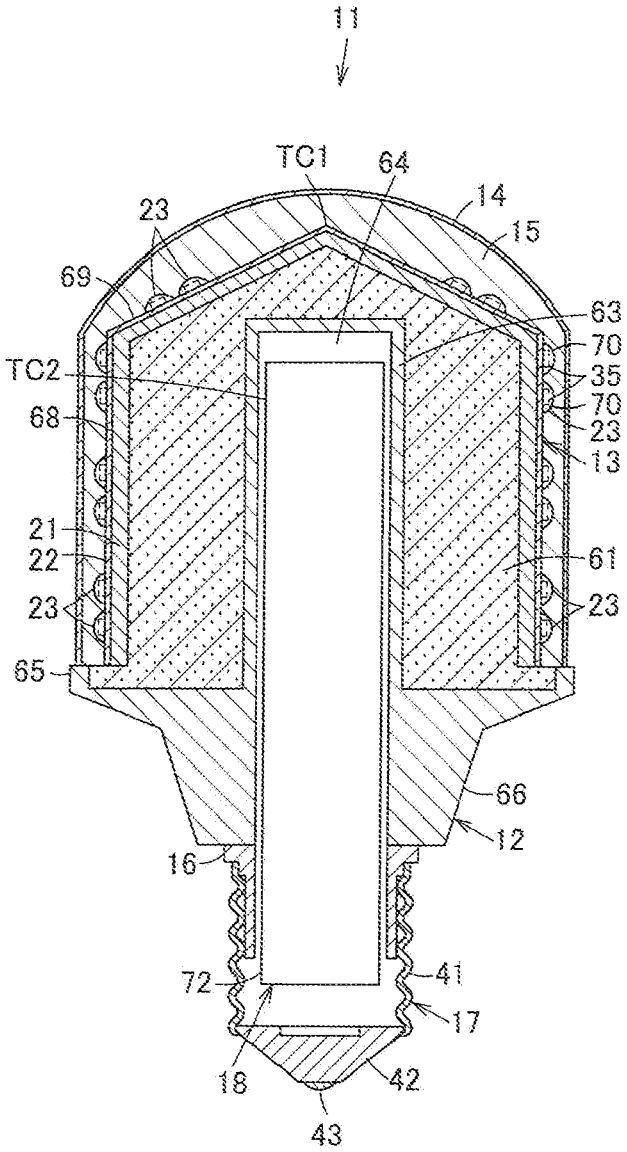
FIG. 5 is a cross sectional view of a self-ballasted lamp of Embodiment 2.
Figure 6:
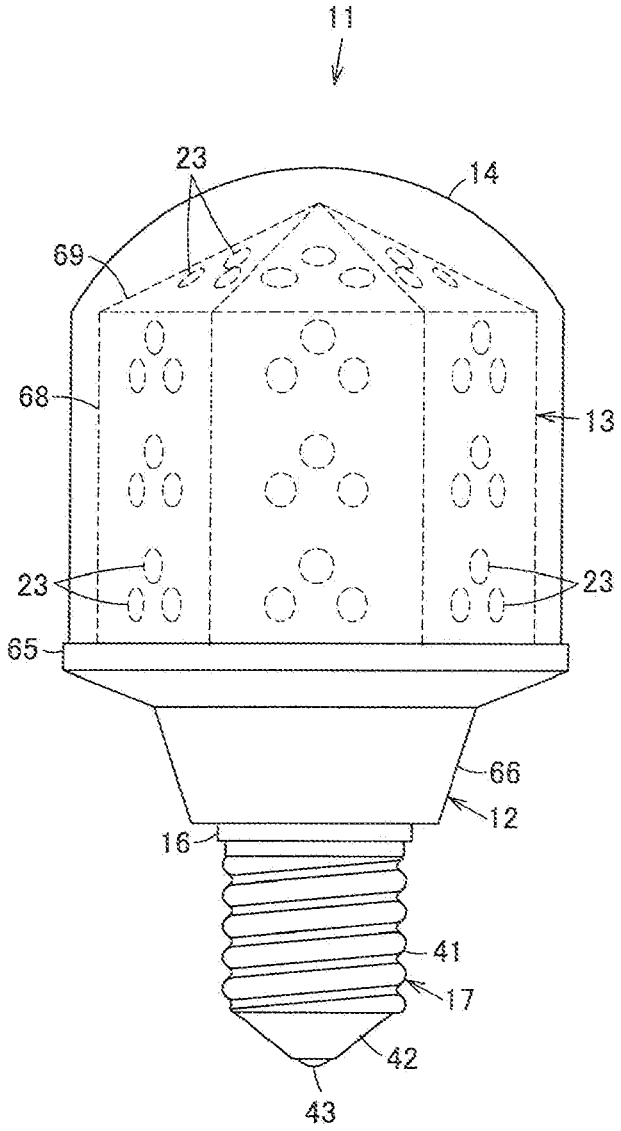
FIG. 6 is a side view of the self-ballasted lamp.

In FIGS. 5 and 6, the reference numeral 11 denotes a mini-krypton size self-ballasted lamp. The self-ballasted lamp 11 includes: a base body 12, a three-dimensional light-emitting module 13 which is projected and attached to one end side (one end side in a lamp axial direction connecting a globe and cap of the self-ballasted lamp 11 to each other) of the base body 12; a globe 14 which contains the light-emitting module 13 and is attached to one end side of the base body 12; a light-transmissive member 15 interposed between the light-emitting module 13 and the globe 14; an insulating unit 61 interposed between the light-emitting module 13 and the base body 12 (lighting circuit 18); an insulating cover 16 attached to the other end side of the base body 12; a cap 17 attached to the other end side of the insulating cover 16; and a lighting circuit 18 housed inside between the base body 12 and the cap 17.

The base body 12 is made of metal such as aluminum excellent in thermal conductivity and is formed in a cylindrical shape the diameter of which increases toward one end side of the base body. A cylindrical partitioning wall portion 63 having a closed top end is projected at the center of one end face of the base body 12, and a housing space 64, which is opened to the other end side of the base body 12 and houses the lighting circuit 18, is formed inside the partitioning wall portion 63. At a circumferential portion of one end face portion of the base body 12, an attachment portion 65 is projected. On the other end side of the base body 12, a heat radiating portion 66 exposed to the outside is formed. Heat radiating fins may be formed at the periphery of the heat radiating portion 66.

The light-emitting module 13 includes: a support portion 21 having, for example, a three-dimensional shape; a substrate 22 arranged along a surface of the support portion 21; and a plurality of light-emitting portions 23 mounted on the substrate 22.

The support portion 21 is made of, for example, insulating material such as PBT resin, and formed in the shape of a polygon such as hexagon, and one end side of the support portion 21 is formed in the shape of a pyramid such as a six-sided pyramid. That is, the support portion 21 is formed in a three-dimensional polyhedron shape in accordance with an inside shape of the globe 14. The inside of the support portion 21 is formed opening toward the other end side. The partitioning wall portion 63 of the base body 12 is inserted from the other end opening of the support portion 21, and arranged inside the light-emitting module 13.

The substrate 22 is integrally formed of, for example, a lead frame and flexible substrate, and has a plurality of circumferential substrate portions 68 arranged along circumferential faces of the support portion 21; and a plurality of top end substrate portions 69 arranged along top end faces of the support portion 21. The substrate portions 68 and 69 may be adhered and fixed to the surface of the support portion 21. The plurality of light-emitting portions 23 are provided on surfaces of the substrate portions 68 and 69.

Each light-emitting portion 23 has an LED chip 35 emitting, for example, blue light as a semiconductor light-emitting element, the LED chips 35 are mounted on the substrate 22 by a COB (Chip On Board) method. A phosphor layer 70 made of, for example, silicone resin, and covers and seals the LED chip 35, which is mounted on the substrate 22, in a dome shape is formed. A yellow phosphor, which is excited by a part of the blue light emitted from the LED chip 35 and radiates yellow light, is mixed in the phosphor layer 70. Accordingly, a surface of the phosphor layer 70 serves as a light-emitting face of the light-emitting portion 23, and white light is radiated from the light-emitting face.

The globe 14 is formed of a material such as synthetic resin or glass, which has light-transmissivity and light-diffuseness, in a dome shape so as to contain and cover the three-dimensional light-emitting module 13. An edge portion of the other end opening of the globe 14 is attached to the attachment portion 65 of the base body 12 by adhesive or the like.

The light-transmissive member 15 made of, for example, transparent resin such as silicone resin is, for example, interposed filling a gap between a surface of the light-emitting module 13 and an inner face of the globe 14 is filled with the member 15 so that almost no air layer exists. In the silicone resin used for the light-transmissive layer 15, inorganic particles mainly containing, for example, silica ($SiO_2$) having an average particle diameter of about 3μ are dispersed at a rate of 3 (silicone resin):1 (inorganic powder) with respect to the silicone resin.

The insulating unit 61 has a thermal conductivity of 0.1 W/mk or less, and a heat insulating Material made of glass wool having a thermal conductivity of 0.033 to 0.050 W/mk is used for the insulating unit 61. Moreover, as the insulating unit 61, polypropylene resin foam heat-insulating material, fumed silica, a calcium silicate heat-insulating material, a vacuum heat-insulating panel, etc., are usable in addition to the glass wool.

In order to make handling of the glass wool excellent, the glass wool is put in a sealable bag and formed into a flexible thin sheet by exhausting air in the bag, the glass wool in the bag is wound around the partitioning wall portion 63 of the base body 12 or arranged along an inner circumferential surface of the light-emitting module 13, the base body 12 and the light-emitting module 13 are coupled with each other, and thus the glass wool in the bag or the insulating unit 61, can be interposed between the base body 12 and the light-emitting module 13.

Alternatively, the glass wool is formed into a cylindrical shape by immersing phenol resin, and the cylindrical glass wool or the insulating unit 61 can be interposed between the base body 12 and the light-emitting module 13.

The heat insulting unit 61 is interposed between one end face of the base body 12, the partitioning wall portion 63 and the attachment portion 65, and the light-emitting module 13 and a part of the light-transmissive material 15, and thermally blocks completely at least between the base body 12 and the light-emitting module 13.

The cover 16 is cylindrically formed of, for example, an insulating material such as a PBT resin, its one end side is fixed to the base body 12 and the other end side thereof is projected from the base body 12.

The cap 17 is, for example, an E17 type cap connectable to a socket for general illumination bulbs and has a shell 41 engaged with, caulked by and fixed to the other end of the cover 16 projecting from the base body 12; an insulating portion 42 provided at the other end side of the shell 91; and an eyelet 43 provided at a top portion of the insulating portion 92.

The lighting circuit 18 is, for example, a circuit for supplying constant current to the LED chips 35 of the light-emitting module 13, and has a circuit substrate 72 on which a plurality of electronic components constituting the circuit are mounted, and the circuit substrate 72 is housed so as to be arranged over the housing space 64 inside the partitioning wall portion 63 of the base body 12, the inside of the cover 16 and the inside of the cap 17. An input side of the lighting circuit 18 is connected to the shell 41 and eyelet 43 of the cap 17 by electric wires, and an output side thereof is connected to the substrate 22 of the light-emitting module 13 by electric wires or the like.

The lighting circuit 18 includes, for example, a rectifying circuit for rectifying alternating current to direct current and a chopper circuit for converting the direct current, which is output from the rectifying circuit, to a predetermined voltage and supplying the voltage to LED chips. A smoothing electrolytic capacitor is used in the lighting circuit 18. However, since the electrolytic capacitor has a heatproof temperature lower than those of the other electronic components, etc., and is easily affected due to temperature rise of the lighting circuit 18, it is preferably mounted on the other end side, which is the cap 17 side located away from the light-emitting module 13, of the circuit substrate 72.

The self-ballasted lamp 11 thus constituted is a mini-krypton self-ballasted lamp size in which the length from the globe 14 to the cap 17 is 80 mm and the maximum diameter of the globe 14 is 45 mm, and the light-emitting module 13 has a current of 0.54 A, a voltage of 12.5V and a total light flux of 600 lm.

Figure 7:
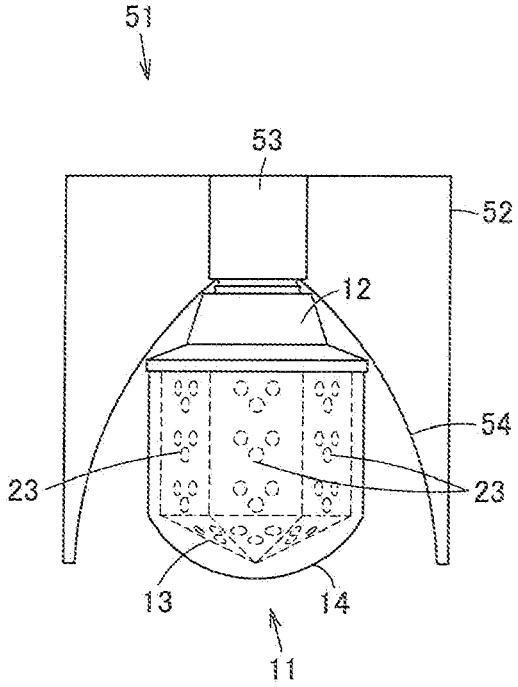
FIG. 7 is a cross sectional view of lighting equipment using the self-ballasted lamp.

FIG. 7 shows lighting equipment 51 which is a downlight using the self-ballasted lamp 11 and, the lighting equipment 51 has an equipment body 52, and a socket 53 and a reflecting body 54 are disposed in the equipment body 52.

When the self-ballasted lamp 11 is energized by attaching the cap 17 to the socket 53 of the lighting equipment 51, the lighting circuit 18 operates, power is supplied to the LED chip 35 of each light-emitting portion 23 of the light-emitting module 13, the LED chips 35 emit light, and the light radiated from the light-emitting face of each light-emitting portion 23 is radiated through the light-transmissive member 15 and the globe 14. Since light-diffusing materials are dispersed in the light-transmissive member 15, the light is diffused and radiated through the globe 14.

Heat generated from the LED chip 35 of each light-emitting portion 23 of the light-emitting module 13 when the self-ballasted lamp 11 is lit is directly conducted from the light-emitting portion 23 to the light-transmissive member 15, and is conducted from the LED chips 35 to the substrate 22 and the support portion 21. The heat is then conducted from a surface of the substrate 22 to the light-transmissive member 15 and further conducted from the light-transmissive member 15 to the globe 14, and radiated from a surface of the globe 14 into the air. Here, since an air layer having a low thermal conductivity, etc., does not exist between the LED chip 35 of each light-emitting portion 23 of the light emitting module 13 and the globe 19, the heat from the LED chips 35 can be efficiently conducted to the globe 14, and high radiation performance from an outer face of the globe 14 can be secured. Thus, temperature rise of the LED chip 35 can be suppressed and the life of the LED chip 35 can be lengthened.

Since the insulating unit 61 is here interposed between the light-emitting module 13 and the base body 12, conduction of heat generated from the LED chips 35 of the light-emitting module 13 to the base body 12 and the lighting circuit 18 housed inside the base body 12 is suppressed.

Accordingly, almost all of the heat generated from the LED chips 35 of the light-emitting module 13 is radiated from the surface of the globe 14 through the light-transmissive member 15.

When the lighting circuit 18 operates, heat is generated from electronic components included in the lighting circuit 18 and conducted to the base body 12. The heat conducted to the base body 12 is radiated in the air from the heat radiating portion 66, which is exposed to the outside the base body 12. The heat generated from the lighting circuit 18 can be efficiently radiated by the metallic base body 12 having the partitioning wall portion 63 interposed between the insulating unit 61 and the lighting circuit 18 and the heat radiating portion 66 exposed to the outside.

Since the insulating unit 61 is here interposed between the light-emitting module 13 and the base body 12, heat conducted to the base body 12 is mainly composed of the heat generated from the lighting circuit 18, the heat generated from the lighting circuit 18 can be efficiently radiated from the heat radiating portion 66 of the base body 12 and the temperature rise of the lighting circuit 18 can be suppressed.

Accordingly, by the insulating unit 61, the light-emitting module 13 and the lighting circuit 18, which are heat generating sources respectively, are separated from each other, and thermal influence to each other can be suppressed.

When temperature distribution of the lit self-ballasted lamp 11 was measured for verifying effects of the insulating unit 61, a top portion of the light-emitting module 13 had a temperature TC1 of 89° C., and a portion, which is located inside the light-emitting module 13 of the circuit substrate 72 of the lighting circuit 18 had a temperature TC2 of 58° C. A difference ΔT between the temperatures was 31° C., and it was confirmed that conduction of the heat, which is generated from the LED chips 35 of the light-emitting module 13, to the lighting circuit 18 is suppressed by the insulating unit 61.

According to the self-ballasted lamp 11 of the present embodiment, reliability of the lighting circuit 18 can be improved, because the light-transmissive member 15 interposed between the light-emitting module 13 and the globe 14 allows the heat generated from the LED chips 35 to be efficiently conducted to the globe 14 and radiated from the surface of the globe 14, and the insulating unit 61 interposed between the light-emitting module 13 and the lighting circuit 18 can suppress the conduction of the heat from the LED chips 35 to the lighting circuit 18 and further suppress the temperature rise, which is caused by the heat from, the LED chips 35, of the lighting circuit 18.

Thus, even when the small-sized mini-krypton type self-ballasted lamp 11 is used, high radiation performance from the globe 14 can be secured, the temperature rise of the LED chips 35 can be suppressed, the temperature rise of the lighting circuit 18 can also be suppressed, and thus light output can be improved by increasing power to be input to the LED chips 35.

Since plastic has a thermal conductivity of about 0.2 to 0.3 W/mk, conduction of the heat from the LED chips 35 to the lighting circuit 18 can be efficiently suppressed as long as the insulating unit 61 has a thermal conductivity of 0.01 W/mk or less.

Preferably, the insulating unit 61 has a thermal conductivity of 0.01 to 0.05 W/mk. In this case, a mini-krypton size self-ballasted lamp 11 having a diameter of 45 mm and a lamp power of 5 W or less can be provided. Further, preferably, the insulating unit 61 has a thermal conductivity of 0.01 W/mk or less. In this case, a mini-krypton size self-ballasted lamp 11 having a diameter of 45 mm and a lamp power of 5 W or larger can be provided.

Moreover, as the insulating unit 61, the following materials may be used in addition to glass wool having a thermal conductivity of 0.033 to 0.50 W/mk: a polypropylene resin foam heat-insulating material having a thermal conductivity of 0.036 W/mk; a calcium silicate heat-insulating material having a thermal conductivity of 0.07 W/mk; a vacuum heat-insulating panel having a thermal conductivity of 0.002 W/mk; and the like.

Additionally, as the insulating unit 61, an air layer may be used which is provided between the light-emitting module 13 and the lighting circuit 18. Since a thermal conductivity of the air layer rises from 0.033 W/mk by generation of a convection current, for example, a convection current suppressing unit for suppressing the convection current of air may be used, the suppressing unit being formed of aluminum foil which is wound into a plurality of layers and inserted into the air layer.

Alternatively, in the case where the insulating unit 61 is constituted by the air layer, a heat radiation suppressing unit may be used in which aluminum is vapor-deposited on an inner face of the light-emitting module 13 facing the lighting circuit 18 and formed into an aluminum mirror face having a low heat radiation rate. Although plastic has a heat radiation rate of 0.90 to 0.95, the aluminum mirror face has a heat radiation rate of about 0.05. Therefore, even in the case where the heat insulting unit 61 is constituted by the air layer, high insulation performance can be obtained.

Since the light-emitting module 13 is formed in the three-dimensional shape and a part of the lighting circuit 18 is housed and arranged in an inner space of the light-emitting module 13, the self-ballasted lamp 11 can be downsized. It is effective for thus downsizing the self-ballasted lamp 11 to use the insulating unit 61.

Although the lighting circuit 18 is arranged inside the light-emitting module 13 in the embodiment, not limited to this arrangement, the lighting circuit 18 may be arranged outside the light-emitting module 13. In this case, the lighting circuit 18 may be arranged inside the base body 12 and the cap 17, and the insulating unit 61 may be interposed between the lighting circuit 18 and the light-emitting module 13.

Moreover, at least a part of the light-transmissive member 15 comes into contact with the light-emitting module 13, and heat can be conducted at a surface side of the light-transmissive member 15. That is, selection of a material of the light-transmissive member 15 or a design on whether the whole or a part of light-emitting module 13 is covered can be made in accordance with the degree of need for heat radiation. Additionally, also a light-transmissive member 15 having a cavity therein is acceptable.

As the semiconductor light-emitting element, an EL (Electra Luminescence) chip can be used in addition to the LED chip.

Moreover, the self-ballasted lamp 11 in which the globe 14 is not used and the light-transmissive member 15 is integrally molded into a desired shape so as to constitute a light-emitting face of the sell-ballasted lamp 11 may be used.

Additionally, the self-ballasted lamp can also be used for a self-ballasted lamp using an E26 type cap.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A self-ballasted lamp comprising:

a base body comprising a partitioning wall portion projected at one end side and a heat radiating portion exposed to an outside on another end side opposite the one end side;

a light-emitting module which is supported by a support portion and comprises:

a plurality of light-emitting portions, each including a semiconductor light-emitting element, and the support portion projected at the one end side of the base body, and in or on which the plurality of light-emitting portions are respectively disposed at least on a circumferential surface of the support portion;

a globe which is provided at the one end side of the base body so as to cover the light-emitting module;

a light-transmissive member filled between the light-emitting module and an inner face of the globe so as to be in contact with the semiconductor light-emitting element and the support portion, and thermally conducting heat of the semiconductor light-emitting element to the globe;

a cap provided at the another end side of the base body opposite to the one end side;

a lighting circuit housed between the partitioning wall portion of the base body and the cap; and an insulating unit interposed between the support portion and the partitioning wall portion.

2. The self-ballasted lamp according to claim 1, wherein a distance between the light-emitting portions of the light-emitting module and the inner face of the globe is 2 mm or less.

3. The self-ballasted lamp according to claim 1, wherein the insulating unit has a thermal conductivity of 0.1 W/mk or less.

4. The self-ballasted lamp according to claim 1, wherein the light-transmissive member is made of silicone resin in which light-diffusing materials are dispersed.

5. Lighting equipment comprising:

an equipment body having a socket; and the self-ballasted lamp according to claim 1 which is attached to the socket of the equipment body.

6. The self-ballasted lamp according to claim 1, wherein the light-transmissive member fills a gap between the light-emitting surface of the light emitting portions and the inner face of the globe.

* * * * *